United States Patent [19]

Bandlish et al.

[11] Patent Number: 4,469,609

[45] Date of Patent: Sep. 4, 1984

[54] STABILIZER SYSTEMS USEFUL IN LUBRICATING OILS AND METHOD FOR STABILIZING LUBRICATING OILS

[75] Inventors: Baldev K. Bandlish, Middlebury; Walter Nudenberg, Newtown, both of Conn.

[73] Assignee: Uniroyal, Inc., New York, N.Y.

[21] Appl. No.: 357,029

[22] Filed: Mar. 11, 1982

[51] Int. Cl.[3] ..... C10M 1/32; C10M 1/54

[52] U.S. Cl. ..... 252/19; 252/26; 252/37; 252/50; 252/37.5; 252/37.2

[58] Field of Search ..... 252/19, 26, 35, 50, 252/37, 37.2

[56] References Cited

U.S. PATENT DOCUMENTS

| | | | |
|---|---|---|---|
| 2,420,446 | 5/1947 | Rocchini et al. | 252/50 |
| 3,282,839 | 11/1966 | Lee | 252/50 |
| 3,634,238 | 1/1972 | Bridger | 252/26 |

*Primary Examiner*—Jacqueline V. Howard
*Attorney, Agent, or Firm*—Andrew D. Maslow

[57] ABSTRACT

The invention comprises a novel stabilizing system useful for imparting resistance to oxidative breakdown comprising:

(1) a metal deactivator azine of the formula:

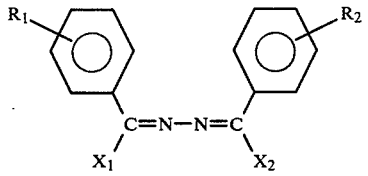

where: $R_1$ and $R_2$ can be hydrogen, alkyl with 1–12 carbon atoms, alkoxy with 1–12 carbon atoms, carbalkoxy with 1–12 carbon atoms, halogen, hydroxy, nitro and amino groups and $X_1$ and $X_2$ can be hydrogen, alkyl with 1–12 carbon atoms or di-, tri- or tetramethylene bridges to the aromatic ring.

(2) an amine;

(3) a metal compound selected from the group consisting of metals or metal salt; and (4) a lubricating oil selected from the group consisting of mineral oils or synthetic hydrocarbon oils.

17 Claims, No Drawings

STABILIZER SYSTEMS USEFUL IN LUBRICATING OILS AND METHOD FOR STABILIZING LUBRICATING OILS

FIELD OF THE INVENTION

The invention relates to the use of novel stabilizer systems consisting of: substitutied azines, or hydrazones, or a molecular complex based on mixture of the two, used in combination with an amine and a metal or metal compound. Addition of any of the above stabilizer systems to lubricating oils provides the oils with an extraordinarily high degree of resistance against oxidative breakdown.

BACKGROUND OF THE INVENTION

Stabilization of lubricating oils with various amines including the parent or substituted diphenylamines, p-phenyl-enediamines, and naphthylamines with various sulfur-containing or nitrogen-containing compounds is shown in the prior art. In Japanese Kokai by Y. Ozaki and coworkers No. Sho 49-1022, May 29, 1974, benzotriazoles are used with above amines to prepare lubricating oils which are stable towards oxidative breakdown and provide protection to metals such as: magnesium, iron, copper, and silver. There appears to be no recognition in the prior art of the use of either azine or hydrazone derivatives with amines to protect lubricating oils against oxidative breakdown and metal corrosion.

SUMMARY OF THE INVENTION

The present invention relates to the use of novel stabilizer systems for lubricating oils which have exceptional ability to stabilize oils against oxidative breakdown.

The object of the invention is to produce a stabilizer system for lubricating oil which provides, after aging of the oil, minimum acid buildup, minimum sludge formation, minimum viscosity increase and no metal corrosion. It has been discovered that the addition of a stabilizer system comprising certain hydrazine derivatives in combination with certain amines and a metal or metal compound to a lubricating oil, particularly, a polyester lubricating oil, produces a lubrication product which has extraordinary oxidation resistance as compared to commercially available lubricating oils, especially polyester lubricating oils.

The specific hydrazine derivatives used are azines, hydrazones or molecular complexes based on mixtures of azines with hydrazones. The azines used in the invention can be represented by the following structural formula:

I

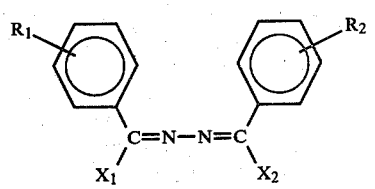

where: $R_1$ and $R_2$ can be hydrogen, alkyl with 1–12 carbon atoms, alkoxy with 1–12 carbon atoms, carbalkoxy with 1–12 carbon atoms, halogen, hydroxy, nitro and amino groups and $X_1$ and $X_2$ can be hydrogen, alkyl with 1–12 carbon atoms or di-, tri- or tetramethylene bridges to the aromatic ring.

Hydrazones used in the invention can be represented by the following structural formula:

II

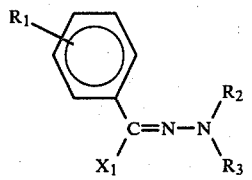

where: $R_1$ can be hydrogen, alkyl with 1–12 carbon atoms, alkoxy with 1–12 carbon atoms, carbolkoxy with 1–12 carbon atoms, halogen, hydroxy, nitro and amino groups, $R_2$ and $R_3$ can be hydrogen or alkyl with 1–12 carbon atoms only and $X_1$ can be hydrogen, alkyl with 1–12 carbon atoms or di-, tri- or tetramethylene bridges to the aromatic ring.

Molecular complex of azines with hydrazones as used in the invention can be represented by the following structural formula:

III

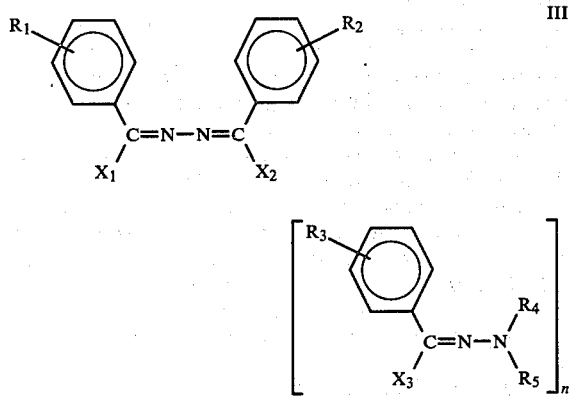

where:

$n = 1–3$, $R_1$, $R_2$ and $R_3$ can be hydrogen, alkyl with 1–12 carbon atoms, alkoxy with 1–12 carbon atoms, carbalkoxy with 1–12 carbon atoms, halogen, hydroxy, nitro, and amino groups, and $R_4$ and $R_5$ can be hydrogen or alkyl with 1–12 carbons and $X_1$, $X_2$ and $X_3$ can be hydrogen, alkyl with 1–12 carbon atoms or di-, tri-, or tetramethylene bridges to the aromatic ring.

Addition of these hydrazine derivatives to lubricating oil, along with amines such as α-phenylnaphthylamine, alkylated α-phenylnaphthylamine, substituted benzylamine, substituted diphenyl amines, substituted anilines and substituted phenothiozines and a metal or a metal salt imparts to said oil a totally unexpected high degree of resistance with respect to oxidative breakdown.

The metal may be added to the oil in one of two forms, as the metal itself or as the salt. The soluble salt is preferably an organic salt due to greater solubility in the oil.

Preferably, the metal incorporated herein is copper, and especially in the form of a copper salt such as copper naphthenates. Cobalt manganese salts are also operative.

Most, if not all, commercially available metal deactivators need the presence of copper in the form of a metal or a metal salt. In the absence of copper, such stabilizer systems fail to provide significant corrosion inhibition or oil stabilization against oxidative breakdown. The present invention provides a system which stabilizes oil and protects metals with or without the presence of copper metal or copper salts. As is the case with other metal deactivators, addition of a large excess of copper salt reduces the effectiveness of the stabilizing system to protect against oxidative breakdown.

The ester oils for which the present antioxidant system is suitable are synthetic lubricants based upon one or more organic carboxylic acid esters intended for use at an operating temperature at or above about 400° F. Examples of such oils include those based on a diester of a dibasic acid and a monohydric alcohol, for instance, dioctyl sebacate or dinonyl adipate; on a triester of trimethylolpropane and a monobasic acid or mixture of monobasic acids, for instance, trimethylolpropane, tripelargonate or tricaprilate; or on a tetraester of pentaerythritol and a monobasic acid or mixture of monobasic acids, for instance, pentaerythritol tetracaprilate; or on complex esters derived from monobasic acids, dibasic acids and polyhydric alcohols; or on mixtures thereof.

The synthetic hydrocarbon oils to which the antioxidant is added are those produced from alpha-olefins of $C_3$ to $C_{14}$ and higher, such as propene, butene, pentene, hexene, heptene, octene, nonene, decene, undecene, dodecene, tridecene and tetradecene, which are oligomerized to produce lubricating oils. Normally, the synthetic hydrocarbon oils usable herein are those having average molecular weights essentially between about 280 and 3,000 preferably between 350 and 2,500. The synthetic hydrocarbon oil must be of low unsaturation since it has been determined that there is a substantially direct relationship between the moles of unsaturation (C=C) and the effectiveness of the antioxidant system. Thus, the synthetic oil should have less than about 0.25 mole of unsaturation per 1,000 gm. of oil, preferably less than 0.15, and most preferably less than 0.05.

The mineral oils to which the present antioxidant system may be added are hydrocarbon-based mineral oils which are substantially acid-free and which possess less than about 0.15 moles of unsaturation per 1,000 gm. of oil, preferably less than 0.1, and most preferably less than 0.05. The difference in the required levels of unsaturation between synthetic hydrocarbon oils and mineral oils is due to the inherently greater instability of the mineral oils.

The various components of the antioxidant system which may be added in any order are used in the following amounts. The amine is used in amounts varying from about 0.1 to 5.0 parts by weight per 100 parts of the oil, preferably, 2.0 to 2.5 parts. The metal deactivator may be used in amounts from 0.5 to 1.0 part by weight per 100 parts of the oil, preferably, 0.1 to 0.3 part. Copper or copper salt is used in the amounts from 1 to 100 parts by weight per million parts of the oil.

The criteria used herein to evaluate the effectiveness of a stabilizing system for lubricating oils are:

(1) the amount of sludge produced,
(2) the change in initial viscosity,
(3) the change in neutralization number; and,
(4) the weight change of the test metals.

These criteria are determined after the oil containing the new antioxidant system has been aged 72 hours at 370° F. and after the oil containing the antioxidant system has been aged for 48 hours at 425° F. The following examples illustrate the invention in greater detail.

EXAMPLE I

This example shows the synergistic result of using the stabilizer system of the present invention to protect a polyester based synthetic oil against oxidative degradation when a hydrazone is used. The oil used was a polyester based lubrication oil Hercolube A which is described in Japanese Kokai, Sho No. 49-21022, supra.

Experiments were carried out in order to evaluate the effectiveness of the stabilizer system. The test samples of Table I, A through D, were prepared by adding N-(α-methylbenzyl)aniline and N,N-dimethyl-α-tetralonehydrazone in the amount set forth in Table I, to 100 grams of the polyester based oil and heating to about 100° C., in order to facilitate the dissolution of the additive. Other samples (Table I) similarly prepared contained a commercially available antioxidant such as Phenyl-α-napthylamine (PAN) or nonyl PAN (N-PAN) along with N,N-dimethyl-α-tetralonehydrazone. The samples A through D in Table II were similarly prepared by adding N-α-methylbenzylaniline and α-tetralonehydrazone in polyester based oil. The amounts used in each case are set forth in Tables I and II.

Each of the samples was tested according to the following test procedures:

A 100 ml. sample having the compositions set forth in Tables I and II is poured into a pyrex glass test cell and aged by inserting one end of a glass air delivery tube into the test cell while the remaining 25 ml. portions of each original oil sample is set aside and analyzed for neutralization number and Saybolt Viscosity at 100° F. Around this glass air delivery tube immersed in the oil was placed from zero to four metal washers (Mg, Cu, Ag, and Fe) as identified in Table I. When more than one washer was used, they were separated from each other by glass spacers. These remained in the oil during the aging process and served to indicate the extent of corrosion of the oil oxidative decomposition products on the metal. The test cell was then fitted with a reflux condenser. The assembly was placed in a constant temperature aluminum block. An air hose was then attached to the other end of the air delivery tube and the air flow was adjusted so that five liters of air per hour was bubbled through the oil. This aging test was carried out for 48 hours at 425° F. After aging, the oil was filtered hot and the amount of sludge developed was collected and was determined and recorded in milligrams per 100 ml. of the oil. The filtered oil was then analyzed to determine changes in neutralization number and Saybolt Viscosity at 100° F.

The neutralization number was determined by the color-indicator titration method according to ASTM Procedure D974-55T.

The Saybolt Viscosity was determined on a standard Saybolt Viscometer according to ASTM Procedure D445-53T.

The metal washers, which were weighed initially, were then carefully washed and weighed again to determine the weight change in grams.

The data in Table I and II show that when a hydrazone such as N,N-dimethyl-α-tetralone-hydrazone and an amine such as α-methylbenzylaniline are added to a polyester based lubricating oil together with the copper metal, the aged properties of the oil are excellent as noted by very little change in the viscoisty or neutralization number, very low sludge and essentially no weight change in the metals. It is also noted that if either the amine or the hydrazone are used individually with the copper, the degree of protection is drastically reduced.

Similarly, N,N-dimethyl-α-tetralone-hydrazone when added along with other commercially available antioxidants such as PAN, LO-6 (a high purity grade of alkylated phenyl-α-napthylamine) and nonyl PAN helps in increasing the efficiency of the stabilizer system to protect the said oil against oxidative breakdown.

EXAMPLE II

This example shows that the synergistic result of using the stabilizer system of the present invention to protect a polyester based lubricating oil against oxidative breakdown when an azine is used. The samples were prepared as in Example I.

The data in Table III shows that when an axine such as α-tetralone-azine or salicylaldehyde-azine and an amine such as α-methylbenzyl-aniline are added to a polyester based lubricating oil together with the copper metal, the aged properties of the oil are excellent, as noted by very little change in viscosity, neutralization number, very low sludge and essentially no weight change in the metals.

It is also noted that if either the amine or the azine are used individually with the copper, the degree of protection is drastically reduced.

Similarly, azines when added along with ohter commercially available antioxidants such as PAN help in increasing the efficiency of the stabilizer system to protect the said oil oxidative breakdown.

EXAMPLE III

This example demonstrates how a combination of azines with hydrazones affect the stabilization of a polyester based oil.

(A) To tetralone (200 ml.) at 0° C., $H_2S$ is bubbled for 45 minutes.

To the reaction mixture, $NH_2$—$NH_2.H_2O$ (64% water) (150 ml.) was then added slowly with continuous stirring. It was stirred for an hour and then $H_2S$ is bubbled for 15 minutes. The reaction mixture was left for 5 days during which time, a yellow solid precipitated from the reaction mixture. It was then crystallized from hexane to give a combination of α-tetralone-azine (1.0 mole) with α-tetralone-hydrazone (2.0 mole) m.p. 102°-109° C.

(B) The above composition can also be prepared by grinding together two moles of α-tetralone-hydrazone with one mole of α-tetralone-azine.

This composition (which is either a solid solution, a molecular complex or a unique mixture) stabilizes the said oil more than the stabilization provided by either of the individual components. In other words, the data in Table IV shows the synergistic result of using the stabilizer system consisting of an amine such as α-methylbenzyl-aniline, an azine such as α-tetralone-azine and a hydrazone such as α-tetralone-hydrazone along with the copper metal.

Similarly, Table V shows that the said composition when added along with other commercially available antioxidants such as PAN helps in increasing the efficiency of the stabilizer system to protect said oil against oxidative breakdown.

EXAMPLE IV

This example shows that the corrosion inhibitor of the present invention; i.e., a combination of the hydrazone with the azine, can be used in the absence of copper without greatly effecting its ability to protect the said oil against oxidative breakdown. Some of the other commercially available corrosion inhibitors such as benzotriazole derivatives (Japanese Kokai SHO No. 49-1022 supra), sulfides (down in U.S. Pat. Nos. 4,122,021 and 4,110,234), etc., can not be used in the absence of copper without losing drastically their ability to protect the said oil.

The data in Table VI shows that when an amine such as α-methyl-benzyl-aniline is used along with a combination of α-tetralone-azine and α-tetralone-hydrazone, the polyester-based lubricating oil is greatly protected with or without the presence of copper. It is also noted that when the same amine is used along with commercially available corrosion inhibitor such as Reomet-38 in the absence of copper, essentially no protection is provided to the said oil. However, all of the above mentioned stabilizer systems are ineffective when a large excess of copper is present.

Other hydrazones which may be as part of the invention are α-tetralone hydrazone, N,N-dimethyl-α-tetralone hydrazone, p-methylacetophenone hydrazone.

Other azines which may be used as part of the invention are α-tetralone azine, salicyladelhyde azine, p-methylacetophenone azine.

TABLE I

USE OF DIMETHYLTETRALONE HYDRAZONE AS METAL DEACTIVATOR IN HERCOLUBE A

| SAMPLE | A.O. SYSTEM | GRAMS | M.D.[1] | GRAMS M.D. | N.N.[2] | % CHANGE IN VISCOSITY | SLUDGE mg | WEIGHT CHANGE OF WASHING GRAMS Mg. | Fe. | Cu. | Ag. |
|---|---|---|---|---|---|---|---|---|---|---|---|
| A | MBA[4] | 2.0 | DMTH[5] | 0.0 | 2.6 | 18.81 | 19.7 | 0.0001 | 0.0004 | −0.0011 | 0.0001 |
| B | MBA | 2.2 | DMTH | 0.1 | 0.79 | 17.03 | 8.4 | 0.0001 | 0.0002 | −0.0006 | 0.0000 |
| C | MBA | 2.2 | DMTH | 0.3 | 1.56 | 9.18 | 12.9 | 0.0000 | 0.0001 | −0.0007 | −0.0002 |
| D | MBA | 2.2 | DMTH | 0.4 | 1.29 | 17.72 | 24.2 | −0.0003 | 0.0000 | −0.0008 | −0.0003 |
| E | PAN[7] | 2.0 | DMTH | 0.0 | 2.2 | 31.5 | 135.7 | −0.0130 | — | −0.0024 | −0.0001 |
| F | PAN | 2.0 | DMTH | 0.5 | 2.2 | 22.60 | 39.1 | — | — | −0.0005 | — |
| G | N—PAN[7] | 2.0 | DMTH | 0.0 | 3.27 | 39.83 | 6.9 | −0.0248 | −0.0002 | −0.0324 | −0.0003 |
| H | N—PAN | 2.0 | DMTH | 0.3 | 2.18 | 25.40 | 27.4 | −0.0287 | 0.0000 | −0.0254 | −0.0001 |

[1]M.D. — Metal Deactivator
[2]N.N. — Neutralization number of the aged oil.
[3]Percent change in viscosity at 100° F.
[4]MBA — α-Methyl benzylaniline
[5]DMTH — N,N—dimethyl-α-tetralone hydrazone.
[6]PAN — Phenyl-α-naphthylamine.
[7]N—PAN — Nonylated phenyl-α-naphthylamine.

TABLE II

USE OF TETRALONE HYDRAZONE AS METAL DEACTIVATOR IN HERCOLUBE A

| SAMPLE | A.O. SYSTEM | GRAMS | M.D. | GRAMS M.D. | N.N. | % CHANGE IN VISCOSITY | SLUDGE mg | WEIGHT CHANGE OF WASHING GRAMS Mg. | Fe. | Cu. | Ag. |
|---|---|---|---|---|---|---|---|---|---|---|---|
| A | MBA[1] | 2.0 | TH[2] | 0.15 | 1.0 | 14.7 | 11.2 | 0.0002 | 0.0002 | −0.0011 | −0.0001 |
| B | MBA | 2.0 | TH | 0.3 | 1.1 | 9.34 | 8.7 | 0.0002 | 0.0003 | −0.0006 | 0.0000 |
| C | MBA | 2.0 | TH | 0.1 | 1.67 | 15.9 | 15.2 | 0.0003 | 0.0000 | −0.0014 | −0.0002 |
| D | MBA | 2.0 | TH | 0.07 | 2.10 | 19.42 | 20.4 | −0.0001 | 0.0000 | −0.0017 | −0.0001 |

[1]MBA — α-Methylbenzylaniline.
[2]TH — α-Tetralone hydrazone.

TABLE III

USE OF AZINES AS METAL DEACTIVATOR IN HERCOLUBE A

| SAMPLE | A.O. SYSTEM | GRAMS | M.D. | GRAMS M.D. | N.N. | % CHANGE IN VISCOSITY | SLUDGE mg | WEIGHT CHANGE OF WASHING GRAMS Mg. | Fe. | Cu. | Ag. |
|---|---|---|---|---|---|---|---|---|---|---|---|
| A | | | | | | | | | | | |
| B | MBA | 2.0 | | | 2.64 | 18.81 | 19.7 | 0.0001 | 0.0004 | −0.0011 | 0.001 |
| C | MBA | 2.0 | TA[1] | 0.07 | 1.10 | 11.24 | 15.5 | 0.0001 | 0.0001 | −0.0013 | −0.0002 |
| D | MBA | 2.0 | TA | 0.1 | 1.09 | 17.42 | 14.09 | 0.0001 | 0.0000 | −0.0013 | −0.0001 |
| E | MBA | 2.0 | TA | 0.3 | 1.6 | 15.23 | 26.5 | 0.0002 | 0.0002 | −0.0014 | 0.0000 |
| F | PAN | 2.0 | | | 2.2 | 31.5 | 135.7 | −0.0130 | — | −0.0024 | −0.0001 |
| G | PAN | 2.0 | SA[2] | 0.2 | 1.66 | 19.32 | 11.7 | 0.0000 | 0.0000 | −0.0016 | −0.0001 |

[1]TA — α-Tetralone-azine.
[2]SA — Salicylaldehydrazine.

TABLE IV

USE OF A MOLECULAR COMPLEX CONTAINING —TETRALONE AND —TETRALONE AZINE AS A METAL DEACTIVATOR IN HERCOLUBE A

| SAMPLE | A.O. SYSTEM | GRAMS | M.D. | GRAMS M.D. | N.N. | % CHANGE IN VISCOSITY | SLUDGE mg | WEIGHT CHANGE OF WASHING GRAMS Mg. | Fe. | Cu. | Ag. |
|---|---|---|---|---|---|---|---|---|---|---|---|
| A | | | M.C.[1] | 0.12 | | -Undetermined- | | −0.1288 | −0.0092 | −0.0104 | 0.0001 |
| B | MBA | 2.0 | | | 2.6 | 18.81 | 19.7 | 0.0001 | 0.0004 | −0.0011 | 0.0001 |
| C | MBA | 2.0 | M.C. | 0.12 | 1.09 | 9.18 | 17.3 | 0.0002 | 0.0001 | −0.0008 | 0.0000 |
| D | MBA | 2.0 | M.C. | 0.1 | 1.5 | 9.14 | 12.8 | 0.0002 | 0.0002 | −0.0007 | 0.0000 |
| E | MBA | 2.0 | M.C. | 0.08 | 1.2 | 17.72 | 14.1 | 0.0002 | 0.0000 | −0.0015 | 0.0000 |
| F | MBA | 2.0 | M.C. | 0.07 | 2.2 | 16.03 | 15.7 | 0.0002 | −0.0001 | −0.0020 | −0.0001 |
| G | MBA | 2.0 | M.C. | 0.1 | 1.64 | 9.23 | 16.7 | 0.0001 | 0.0000 | −0.0009 | 0.0000 |
| H | MBA | 2.0 | M.C. | 0.1 | 1.5 | 9.14 | 12.8 | 0.0002 | 0.0002 | −0.0007 | 0.0000 |
| I | MBA | 2.0 | M.C. | 0.2 | 1.57 | 17.78 | 15.6 | 0.0001 | 0.0003 | −0.0007 | 0.0000 |
| J | MBA | 2.0 | M.C. | 0.3 | 1.62 | 17.12 | 23.0 | 0.0001 | 0.0002 | −0.0008 | −0.0002 |
| K | MBA | 2.5 | M.C. | 0.1 | 1.7 | 14.33 | 21.3 | −0.0002 | 0.0000 | −0.0014 | −0.0001 |
| L | MBA | 2.5 | M.C. | 0.3 | 1.66 | 17.89 | 18.8 | 0.0002 | 0.0001 | −0.0002 | −0.0002 |
| M | MBA | 2.5 | M.C. | 0.4 | 2.18 | 13.80 | 20.8 | 0.0003 | 0.0001 | −0.0001 | −0.0001 |
| N | MBA | 3.0 | M.C. | 0.1 | 1.6 | 8.15 | 89.4 | −0.0104 | −0.0001 | −0.0001 | −0.0001 |

[1]M.C.: A molecular complex containing α-tetralone hydrazone and α-tetralone azine.
[2]Aged oil was so viscous that it could not be filtered to determine the amount of sludge formed or to determine the properties of the aged oil.

TABLE V

USE OF MOLECULAR COMPLEX CONTAINING —TETRALONE HYDRAZONE AND —TETRALONE AZINE AS METAL DEACTIVATOR IN HERCOLUBE A

| SAMPLE | A.O. SYSTEM | GRAMS | M.D. | GRAMS M.D. | N.N. | % CHANGE IN VISCOSITY | SLUDGE mg | WEIGHT CHANGE OF WASHING GRAMS Mg. | Fe. | Cu. | Ag. |
|---|---|---|---|---|---|---|---|---|---|---|---|
| A | PAN | 2.0 | | | 2.2 | 31.5 | 135.7 | −0.0130 | — | −0.0024 | −0.0001 |
| C | PAN | 2.0 | M.C.[1] | 0.2 | 1.06 | 19.74 | 24.4 | 0.0001 | 0.0002 | −0.0006 | 0.0000 |
| B | PAN | 2.0 | M.C. | 0.1 | 1.6 | 25.31 | 25.2 | 0.0001 | −0.0001 | −0.0010 | 0.0000 |
| D | PAN | 2.0 | M.C. | 0.3 | 1.03 | 28.7 | 26.1 | 0.0003 | 0.0002 | −0.0003 | 0.0000 |
| E | PAN | 2.0 | M.C. | 0.4 | 1.10 | 25.33 | 31.9 | 0.0003 | 0.0003 | −0.0003 | 0.0000 |
| F | PAN | 2.0 | M.C. | 0.5 | 2.2 | 20.65 | 35.4 | 0.0002 | 0.0002 | −0.0001 | 0.0001 |
| G | PAN | 2.0 | M.C. | 1.0 | 2.2 | 24.53 | 60.5 | 0.0003 | 0.0002 | 0.0004 | −0.0004 |

[1]M.C. A molecular complex containing α-tetralone hydrazone and α-tetralone azine.

TABLE VI

EFFECT OF COPPER ON ANTIOXIDANT SYSTEMS IN HERCOLUBE A

| SAMPLE | A.O. SYSTEM | GRAMS | M.D. | GRAMS M.D. | N.N. | % CHANGE IN VISCOSITY | SLUDGE mg | WEIGHT CHANGE OF WASHING GRAMS Mg. | Fe. | Cu. | Ag. | COPPER NAPHTHENATE PARTS/MILLION |
|---|---|---|---|---|---|---|---|---|---|---|---|---|
| A | MBA | 2.0 | | | 2.7 | 13.68 | 5.1 | −0.0003 | 0.0003 | | −0.0017 | |
| B | MBA | 2.0 | | | 2.6 | 18.81 | 19.7 | 0.0001 | 0.0004 | −0.0011 | 0.0001 | |
| C | MBA | 2.0 | M.C.[1] | 0.3 | 6.89 | 25.90 | 12.2 | −0.0001 | 0.0005 | | −0.0003 | |
| D | MBA | 2.0 | M.C. | 0.3 | 1.62 | 17.12 | 23 | 0.0001 | 0.0002 | −0.0008 | −0.0002 | |
| E | MBA | 2.0 | REOMET-38[2] | 0.3 | 5.60 | 32.05 | 560.7 | −0.0594 | 0.0007 | | −0.0001 | |
| | MBA | 2.0 | REOMET-38 | 0.3 | 1.60 | 7.61 | 6.7 | 0.0000 | 0.0003 | −0.0001 | −0.0002 | |
| F | MBA | 2.0 | M.C. | 0.3 | 2.23 | 20.70 | 154.6 | −0.0116 | 0.0002 | −0.0019 | −0.0001 | 30 |
| G | MBA | 2.0 | REOMET-38 | 0.3 | 1.59 | 17.76 | 173.3 | −0.0116 | −0.0001 | −0.0003 | −0.0002 | 30 |
| H | MBA | 2.0 | M.C. | 0.3 | 8.85 | 28.37 | 699.8 | 0.0307 | 0.0001 | −0.0019 | | 200 |

[1]M.C.: A molecular complex of α-tetralone hydrazone with α-tetralone azine.
[2]REOMET-38: Commercially available metal deactivator. (A liquid benzotriazole derivative)

We claim:

1. A lubricating composition comprising (a) a lubricating oil selected from the group consisting of polyester based oil, mineral oil and synthetic hydrocarbon oil, (b) an amine, selected from the group consisting of phenylnaphthylamine, alkylated phenylnaphthylamine, substituted benzylamine, substituted diphenylamines, substituted aniline and substituted phenothiazine, (c) a compound selected from the group consisting of an azine having the formula

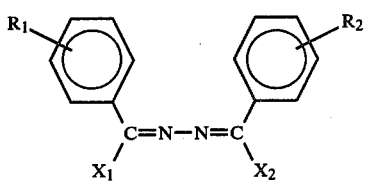

(I)

and a hydrazone having the formula

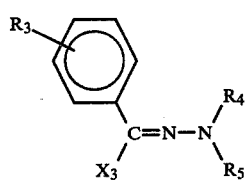

(II)

wherein $R_1$, $R_2$ and $R_3$ are hydrogen, $C_1$–$C_{12}$ alkoxy, $C_1$–$C_{12}$ carbalkoxy, halogen, hydroxy, nitro or amino, $R_4$ and $R_5$ are hydrogen or $C_1$–$C_{12}$ alkyl; and $X_1$, $X_2$ and $X_3$ are hydrogen, $C_1$–$C_{12}$ alkyl or di-, tri-, or tetramethylene bridges to the aromatic ring; and mixtures of (I) and (II) at a molar (I)/(II) ratio of 1/1/–1/3.

2. The composition of claim 1 further comprising a metal compound selected from the group consisting of copper, cobalt, manganese and salts of copper, cobalt or manganese.

3. A composition as claimed in claim 1 or 2 wherein said amine is selected from the group consisting of α-phenylnaphthylamine, alkylated α-phenylnaphthylamine or substituted benzylamine.

4. A composition as claimed in claim 1 or 2 wherein said metal compound comprises an organic metallic salt.

5. A composition as claimed in claim 1 or 2 wherein said lubricating oil is a synthetic oil based upon an organic corboxylic acid ester.

6. A composition as claimed in claim 1 wherein said hydrazone is α-tetralone hydrazone, N,N-dimethyl-α-tetralone hydrazone, p-methylacetophenone hydrazone.

7. A composition as claimed in claim 1 wherein said hydrazone is α-tetralone azine, salicyladelhyde azine, p-methylacetophenone azine.

8. A composition as claimed in claim 4 wherein said organic metallic salt is selected from the group consisting of naphthenates, stearates, acetylacetonates, octoates or decanoates.

9. A composition as claimed in claim 1 or 2 wherein said metal is copper and said metal salt is a copper salt.

10. A composition as claimed in claim 4 wherein said organic metallic salt comprises a copper naththenate.

11. A composition as claimed in claim 4 wherein said organic metallic salt comprises cobalt manganese.

12. A composition according to claim 5 wherein said synthetic oil is selected from the group consisting of diesters based upon a dibasic acid and a monohydric alcohol; triesters based upon a trimethylpropane and a monobasic acid or mixture of monobasic acids; a tetraester based on pentaerythritol and a monobasic acid or mixture of monobasic acids, a complex ester derived from monobasic acids, dibasic acids and polyhydric alcohols; or on mixtures of the above members of the group.

13. A composition according to claim 5 wherein the synthetic hydrocarbon oil is produced from alpha-olefins of $C_3$ to $C_{14}$ and are oligomerized to produce said lubricating oil, said synthetic hydrocarbon oil having an average molecular weight essentially between about 280 and 2,000, said synthetic oil having less than 0.25 mole of unsaturation per 1,000 gm. of oil.

14. A composition according to claim 13 wherein said average molecular weight of said synthetic hydrocarbon oil is between 350 and 1,500 and having less than 0.15 moles of unsaturation per 1,000 grams of oil.

15 A composition according to claim 1 or 2 wherein said lubricating oil is a hydrocarbon based mineral oil.

16. A composition according to claim 15 wherein said hydrocarbon based mineral oil possesses less than 0.05 moles of unsaturation per 1,000 grams of oil.

17. A composition according to claim 1 or 2 wherein said metal deactivator comprises 0.05 to 1.0 parts by weight per 100 parts of said lubricating oil, said amine comprises 0.1 to 5.0 parts of weight per 100 parts of said lubricating oil, said metal comprises copper or copper salt in the amount from 1 to 100 parts by weight per million parts of said lubricating oil.

* * * * *